US010918139B2

(12) United States Patent
Toth

(10) Patent No.: US 10,918,139 B2
(45) Date of Patent: Feb. 16, 2021

(54) UNDERGARMENT CLIP

(71) Applicant: Dina Sue Toth, Wright City, MO (US)

(72) Inventor: Dina Sue Toth, Wright City, MO (US)

( * ) Notice: Subject to any disclaimer, the term of this patent is extended or adjusted under 35 U.S.C. 154(b) by 140 days.

(21) Appl. No.: 16/001,647

(22) Filed: Jun. 6, 2018

(65) Prior Publication Data

US 2019/0133211 A1 May 9, 2019

Related U.S. Application Data

(60) Provisional application No. 62/515,905, filed on Jun. 6, 2017.

(51) Int. Cl.

| | |
|---|---|
| ***A41C 3/12*** | (2006.01) |
| ***A41C 3/00*** | (2006.01) |
| *A44C 1/00* | (2006.01) |

(52) U.S. Cl.

CPC ..... *A41C 3/126* (2013.01); *A41C 3/0007* (2013.01); *A44C 1/00* (2013.01)

(58) Field of Classification Search

CPC ..... A41C 3/0007; A41C 3/126; A44C 1/00
See application file for complete search history.

(56) References Cited

U.S. PATENT DOCUMENTS 1,591,263 A * 7/1926 Aymer ..... A41F 15/02 24/543
2,943,295 A * 6/1960 Stewart ..... H01H 85/24 439/831
3,327,358 A * 6/1967 Schick ..... F16G 3/02 24/33 R
3,345,714 A * 10/1967 Finkel ..... A41F 11/08 24/487
4,807,334 A * 2/1989 Blanchard ..... A44B 99/00 223/91
4,853,625 A * 8/1989 Fodali ..... G01R 1/06788 324/754.02
5,062,846 A * 11/1991 Oh ..... A61B 17/122 606/158
5,159,730 A * 11/1992 Radvin ..... A44B 99/00 24/543
5,366,458 A * 11/1994 Korthoff ..... A61B 17/122 606/151
5,464,416 A * 11/1995 Steckel ..... A61B 17/122 606/158
5,487,746 A * 1/1996 Yu ..... A61B 17/122 24/115 A
D373,098 S * 8/1996 Lee ..... D11/215
5,695,505 A * 12/1997 Yoon ..... A61B 17/0487 606/151
D684,087 S * 6/2013 Frank ..... D11/212
9,500,209 B2 * 11/2016 Bonno ..... A45F 5/00
(Continued)

*Primary Examiner* — Robert Sandy
*Assistant Examiner* — David M Upchurch
(74) *Attorney, Agent, or Firm* — Sandberg Phoenix and von Gontard, PC

(57) ABSTRACT

An undergarment clip constraining the undercup support bands and wires of a brassiere or similar undergarment, and in particular a novel clip designed to attach to the edge of a brassiere having an underwire support to limit the protrusion of the underwire through the brassiere material. The device can also be utilized to similarly constrain boning and other support components in brassieres, corsets and other such undergarments.

34 Claims, 5 Drawing Sheets

(56) References Cited

U.S. PATENT DOCUMENTS

| | | | | |
|---|---|---|---|---|
| 2003/0182773 | A1* | 10/2003 | Ellwood | F16B 2/10 24/334 |
| 2004/0037669 | A1* | 2/2004 | Bauer | F16B 9/023 411/523 |
| 2006/0010661 | A1* | 1/2006 | Murphy | A41F 17/02 24/545 |
| 2006/0042050 | A1* | 3/2006 | Misumi | A47G 25/485 24/3.1 |
| 2006/0213036 | A1* | 9/2006 | Flowers | A41F 17/02 24/72.1 |
| 2007/0050955 | A1* | 3/2007 | Hansen | F16B 5/0614 24/297 |
| 2007/0078315 | A1* | 4/2007 | Kling | A61B 5/14552 600/323 |
| 2008/0072403 | A1* | 3/2008 | Peck | B42F 1/02 24/67.9 |
| 2009/0215360 | A1* | 8/2009 | Brideson | A41F 15/02 450/86 |
| 2010/0254123 | A1* | 10/2010 | Brown | A42B 1/24 362/191 |
| 2012/0255148 | A1* | 10/2012 | Khoury | A41F 1/00 24/458 |
| 2015/0320190 | A1* | 11/2015 | Gaudet | A45F 5/02 24/3.12 |
| 2018/0279749 | A1* | 10/2018 | Quillmann | A45F 5/02 |

* cited by examiner

UNDERGARMENT CLIP

CROSS REFERENCE TO RELATED APPLICATIONS

This application derives and claims priority from U.S. provisional application 62/515,905 filed Jun. 6, 2017 which is incorporated herein by reference.

BACKGROUND OF THE INVENTION

The invention is related generally to a protective clip for apparel, and more specifically, to an improved device for constraining the support bands and wires of a brassiere or similar undergarment, and in particular a novel clip designed to attach to a brassiere constructed with an underwire support along the edge of the brassiere in proximity to an end of the underwire so as to protect the wearer from chafing or rubbing from the end of the underwire pressing against the wearer's skin either by protrusion through the brassiere material or from an exposed underwire. Various embodiments of the device can also be utilized to similarly constrain boning and other support rods and/or similar components housed in fabric sleeves of brassieres, corsets and other such undergarments so as to protect the wearer from the protrusion of such rods and/or components through the undergarment material.

It is well known that many fabric undergarments are constructed with components that are rigid or stiff, which often have ends or edges that are sharp or pointed or otherwise capable of protrusion through the fabric of the undergarment. Such components include, for example, the underwire of a brassiere or the boning in a corset. Undergarments are generally designed and constructed to house such components within the fabric of the undergarment, such as for example in a sleeve, or to position fabric or some other soft buffer between such components and the wearer. However, often the construction of the undergarment is insufficient to fully protect the user from pain or discomfort arising from a rigid or stiff component pressing through the fabric and against or into the skin. This is particularly true of the ends of underwires in the gore and along the wings of underwire brassieres. Further, if exposed due to wear or damage, these components can chaff, bruise or cut the skin when positioned or pressed against the body when the undergarment is donned, worn or removed. Such exposure can occur as a result of use and wear of the undergarment, and as the fabric ages and loses strength and resilience.

Often, the owner of an undergarment with an underwire or other rigid component that is exposed or has worn or thinning fabric in the vicinity of the component, will dispose of the otherwise usable garment rather than risk injury. This can be very costly. It would therefore be desirable to minimize the potential for such discomfort or injury, and to minimize the casts of replacing undergarments prematurely. Wearers will sometimes apply tape, fingernail polish or even bandages to an exposed underwire or other rigid component of an undergarment. Yet each of these "fixes" each has its own shortcoming and falls short of solving the problem.

A need therefore exists for a compact, comfortable and protective device that can be readily attached to and, if desired, removed from an undergarment that incorporates a rigid or stiff component, such that the device protects a wearer from chafing, rubbing, bruising or other similar discomfort or injury that could otherwise arise from the component during use of the undergarment.

BRIEF DESCRIPTION OF THE DRAWINGS

The illustrative embodiments of the present invention are shown in the following drawings which form a part of the specification.

Corresponding reference characters indicate corresponding parts throughout the several views of the drawings.

DETAILED DESCRIPTION OF THE INVENTION

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 9:
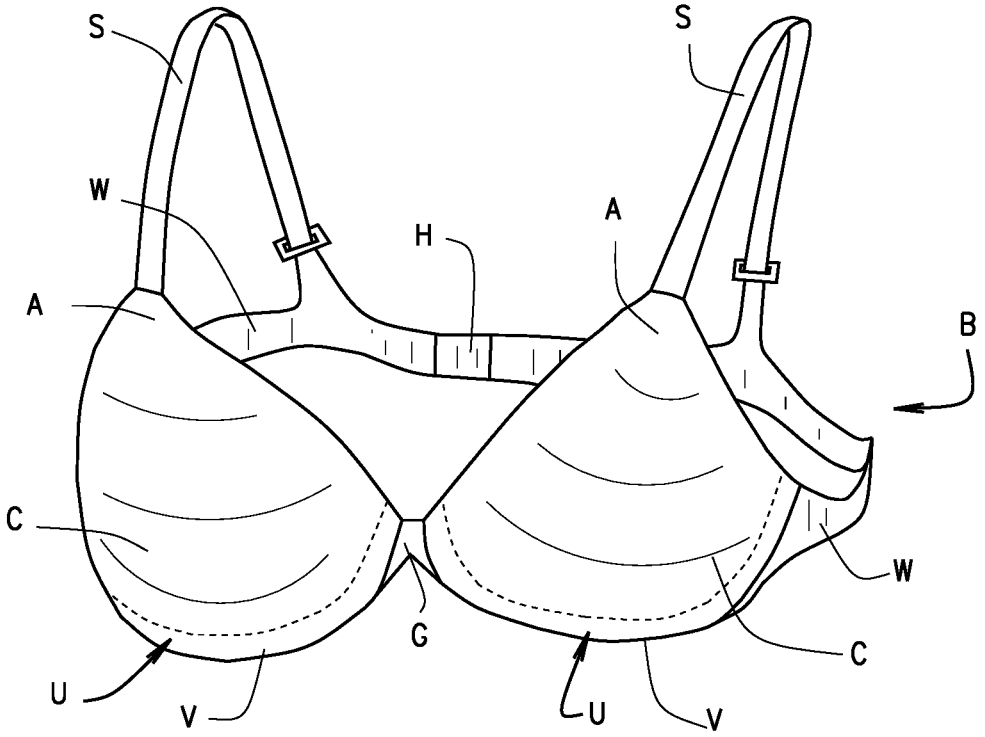
FIG. 9 is a perspective view of a traditional underwire brassiere.

Referring to FIG. 9, it can be seen that a representative brassiere B has two cups C on either side of a center-front gore G. The gore G attaches to the center-most ends of each of the cups C. A pair of wings W extend from the outer sides of each of the cups C and attach together with a hook and eye clasp H. This representative brassiere B includes a set of shoulder straps S that extend from an apex A at the top of each of the cups C and attach to the upper edge of their respective wings W between the cups C and the clasp H. Each of the cups C has a curved underwire channel V sewn along the underside of the cup that runs from the center-front gore G, under the front portion of the cup C, along the full length of the interface between the cup C and the wing W, and terminates at the intersection of the upper edge of the wing W and the cup C. An elongated underwire U is secured within and runs the full length of the underwire channel V. The underwire U is designed to provide form and support to the underside of the brassiere below the breast, but must also be somewhat flexible or pliant for comfort and fit. Accordingly, the underwire U is typically constructed of a strong, yet resilient wire or rod-like material such as, for example, a spring-steel or a strong plastic with limited elasticity. The underwire U may have a cross-section that is circular, oval, rectangular or formed of some other shape. Of course, there exist many different configurations of underwire brassieres, and the brassiere B is depicted by way of representation and not in a limiting sense.

Figure 10:
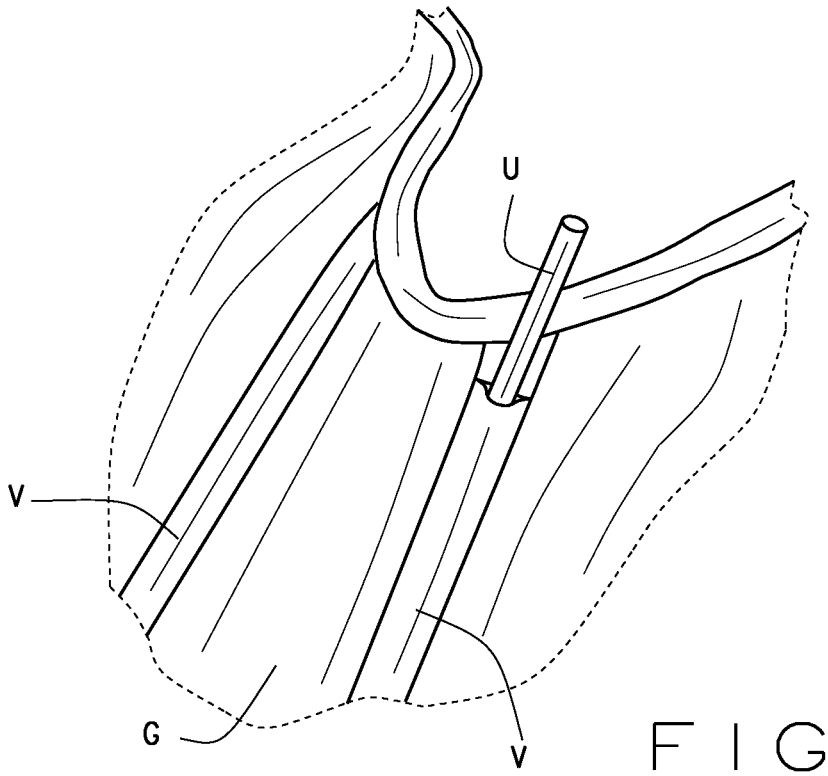
FIG. 10 is a perspective view of an area about the center-front gore of a representative underwire brassiere with one end of one of the underwires protruding out of the end of its respective underwire channel.

FIG. 10 depicts the gore area of a used representative underwire brassiere, such as for example the gore G of FIG. 9, in which the end of one of the brassiere's two underwires has worn a hole through the end of its underwire channel and is protruding through that hole. As can be appreciated, at a minimum such a protrusion can cause discomfort to a person donning such damaged underwire brassiere, but could also cause injury such as cuts, bruises, punctures or scrapes.

In referring again to the drawings, a first representative embodiment of the novel protective clip or undergarment clip 10 of the present invention is shown generally in FIGS. 1-7, where the present invention is depicted by way of example, both independently and in association with a representative brassiere, such as at B.

Referring now to FIGS. 1-7, the entire clip 10 is constructed of a durable, generally rigid, yet slightly pliant plastic or polymer, with a generally flat and "badge-shaped" front blade 12 having an inner face 14, and an outer face 16 generally parallel to and opposite the inner face 14. The front blade 12 also has an upper end 18 and a lower end 20 opposite the upper end 18. A generally flat and rectangular rear blade 22 likewise has an inner face 24, and an outer face 26 generally parallel to and opposite the inner face 24. The rear blade 22 also has an upper end 28 and a lower end 30 opposite the upper end 28. The front blade 12 and the rear blade 22 have approximately the same length. However, while having an irregular shape, the front blade 12 is approximately twice as wide as the rear blade 22.

A slightly arched and elongated spine 32 extends along and joins the upper end 18 of the front blade 12 to the upper end 28 of the rear blade 22. In a relaxed state, the spine 32 holds the front blade 12 and rear blade 22 in an orientation relative to each other such that the lower ends 20 and 30 of the inner faces 14 and 24 of the front and rear blades 12 and 22 touch, or preferably slightly press against each other with a bias engineered to impart a specific force between the two blades. The blades 12 and 22 are not entirely flat, but instead are shaped such that a small and slightly variable gap G is presented between the center portions of the inner faces 14 and 24, although the inner faces 14 and 24 may touch or press against each other as previously mentioned.

The spine 32 is molded to form a semi-circular outer surface with an inner cylindrical cavity 34 along its full length. The cylindrical cavity 34 has a diameter slightly greater than the width of the gap G (see FIGS. 2, 7). The cavity 34 imparts elasticity and strength to the spine 32 when the front blade 12 and rear blade 22 are forced away from each other, such as when the undergarment clip 10 is being placed upon or removed from a brassiere or other undergarment. As can be appreciated, because the clip 10 is constructed of an elastic plastic material or polymer, the spine 32 thereby imparts a spring-tension on the front blade 12 and rear blade 22 that is biased to hold the blades substantially parallel while separated at least in part by the gap G. That is, the front blade 12 and the rear blade 22 can be constructed so as to be separated from one another along the entire gap G or can be constructed so as to press against each other under a desired bias at certain points along the gap G as shown, by way of example in FIGS. 2 and 7.

A set of small horizontal ridges or grips 35 are formed in the lower ends 20 and 30 of the inner faces 14 and 24. When the undergarment clip 10 is positioned on an undergarment, such as for example the underwire brassiere B, the compressive bias between the front blade 12 and rear blade 22 imparts a force on these grips 35 to press against the fabric and structure of the brassiere to which the undergarment clip 10 is attached. As can be appreciated, the grips 35 thereby releasably secure the undergarment clip 10 to the undergarment to reduce the likelihood that the undergarment clip 10 will slide upward or slide off the undergarment. Of course, the grips 35 are not limited to being ridges, but may be formed in a variety of shapes and sizes, such as for example a pattern of small knobs or bumps, so long as the grips 35 are capable of assisting to secure the undergarment clip 10 to an undergarment.

Figure 1:
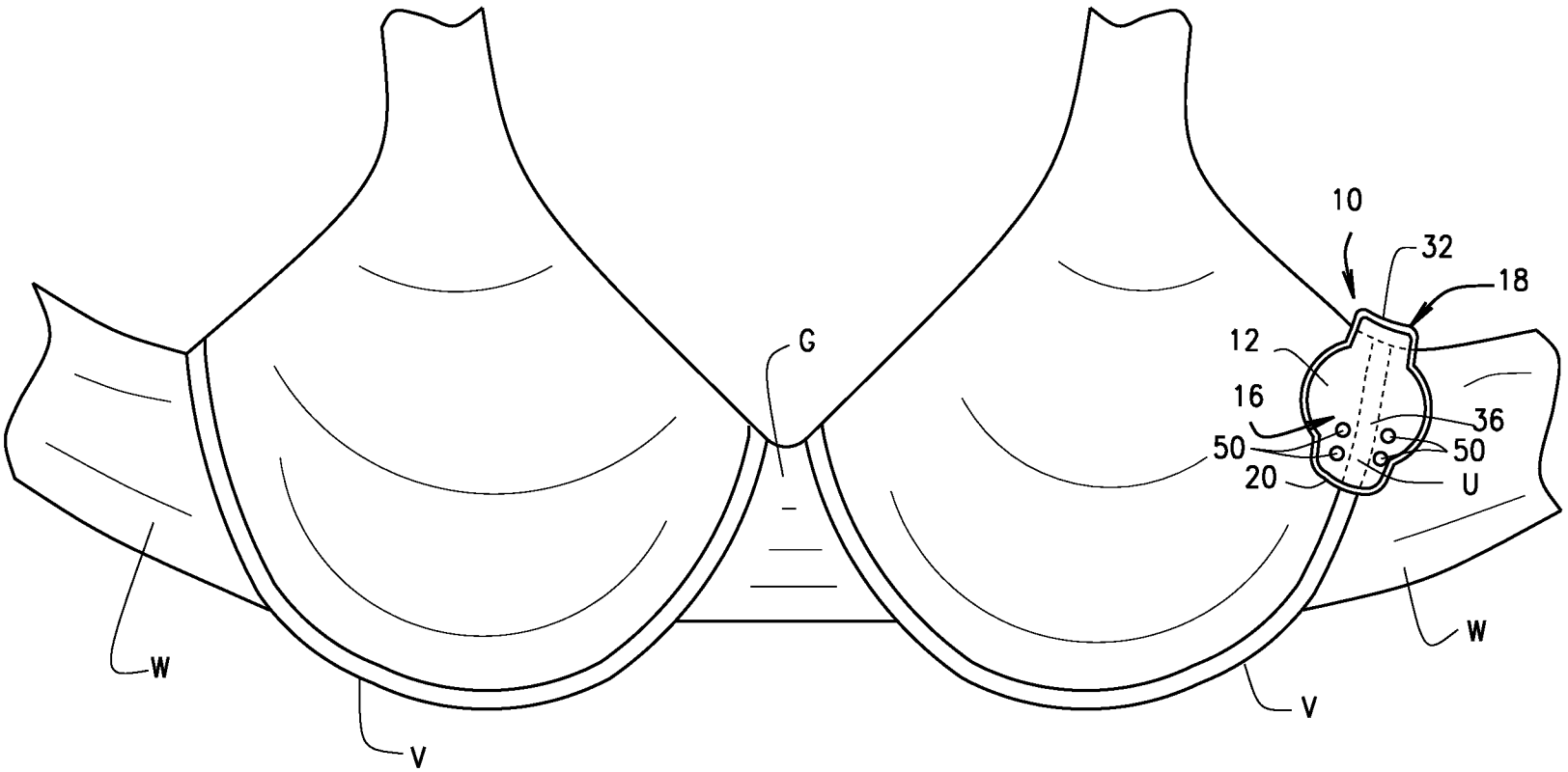
FIG. 1 is a perspective view of a first representative embodiment of the undergarment clip of the present disclosure attached to the upper edge of one side of a representative underwire brassiere, with the undergarment clip positioned over the end of the underwire, and having ghost lines depicting various features of the clip.
Figure 2:
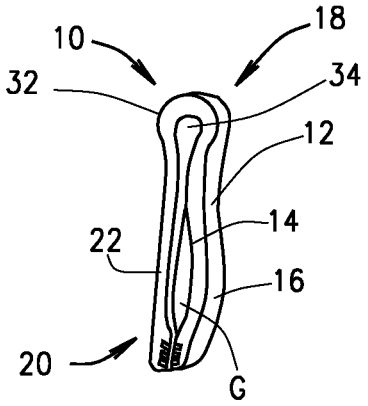
FIG. 2 is a side view of the first representative embodiment of the undergarment clip of FIG. 1.
Figure 3:
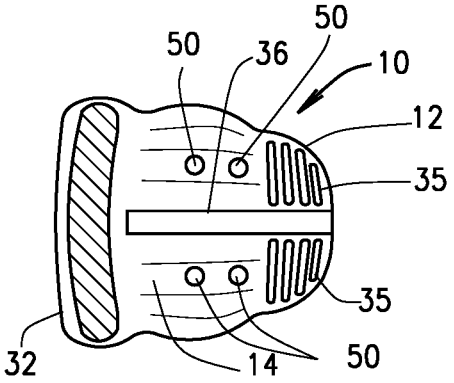
FIG. 3 is a cut-away view of the first representative embodiment of the undergarment clip of FIG. 1, showing the inner face of the front blade of the undergarment clip.
Figure 4:
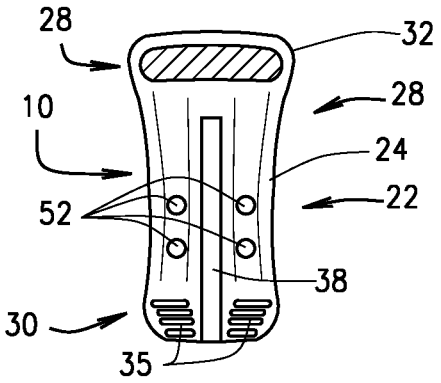
FIG. 4 is a cut-away view of the first representative embodiment of the undergarment clip of FIG. 1, showing the inner face of the rear blade of the undergarment clip.
Figure 5:
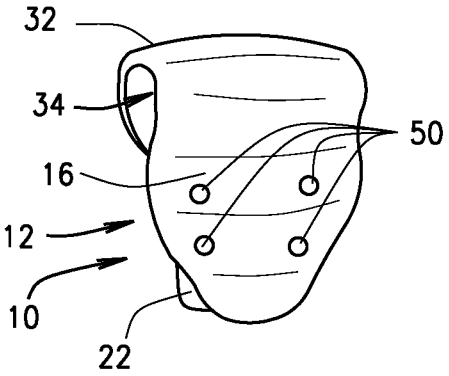
FIG. 5 is a perspective view of the front side of the first representative embodiment of the undergarment clip of FIG. 1.
Figure 6:
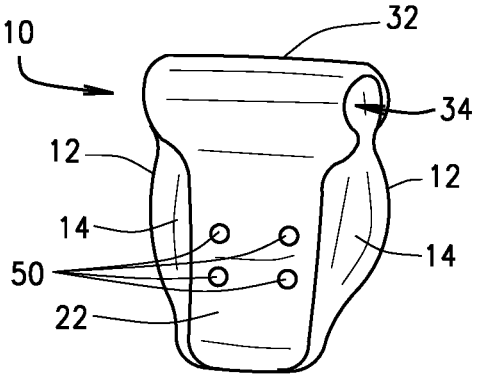
FIG. 6 is a perspective view of the back side of the first representative embodiment of the undergarment clip of FIG. 1.
Figure 7:
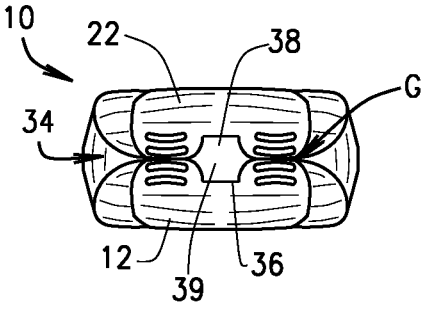
FIG. 7 is a bottom view of the first representative embodiment of the undergarment clip of FIG. 1.

Referring to FIGS. 3 and 7, it can be seen that a substantially linear vertical channel or groove 36 is formed in the inner face 14 of the front blade 12, The groove 36 extends vertically from the center of the bottom edge of the lower end 20 to a point that is a short distance from the cylindrical cavity 34. The groove 36 has a rounded rectangular cross-section that has a depth of approximately half the thickness of the front blade 12 and a width that is slightly greater than its depth. FIG. 4 shows a matching substantially linear vertical channel or groove 38 that is formed in the inner face 24 of the rear blade 22. The groove 38 extends vertically from the center of the bottom edge of the lower end 30 to a point a short distance from the cylindrical cavity 34. Like the groove 36, the groove 38 has a depth of approximately half the thickness of the rear blade 22 and a width that is slightly greater than its depth.

As can be seen in FIG. 7, the grooves 36 and 38 are matched to form a unified track 39 between the inner face 14 of the front blade 12 and the inner face 24 of the rear blade 22. The track 39 is therefore sized and shaped to receive the end length of a brassiere underwire. As can be appreciated, when the undergarment clip 10 is properly placed onto an undergarment (such as for example the brassiere B) over one end of one of the undergarment support components, such as the underwires U as shown by way of example in FIG. 1, the end of the underwire U will fit snugly into the track 39. The undergarment clip 10 thereby prevents the end of the underwire U from chaffing the wearer, even if the end of the underwire U protrudes through the fabric of the brassiere B.

The undergarment clip 10 also features a set of holes or orifices 50 and 52 that allow the undergarment clip 10 to be stitched or sewn to a desired undergarment, such as for example the underwire brassiere B. Such holes or orifices are preferably positioned along the perimeter of the undergarment clip as shown, but can be located at virtually any position on the undergarment clip. Of course, the number, size and shape of the holes 50 and 52 can vary substantially so long as they provide a means by which the undergarment clip 10 can be sewn to an undergarment. Further, the undergarment clip 10 may also be constructed to include tabs or wings or knobs or other such constructs through which the holes or orifices 10 are formed.

Figure 8:
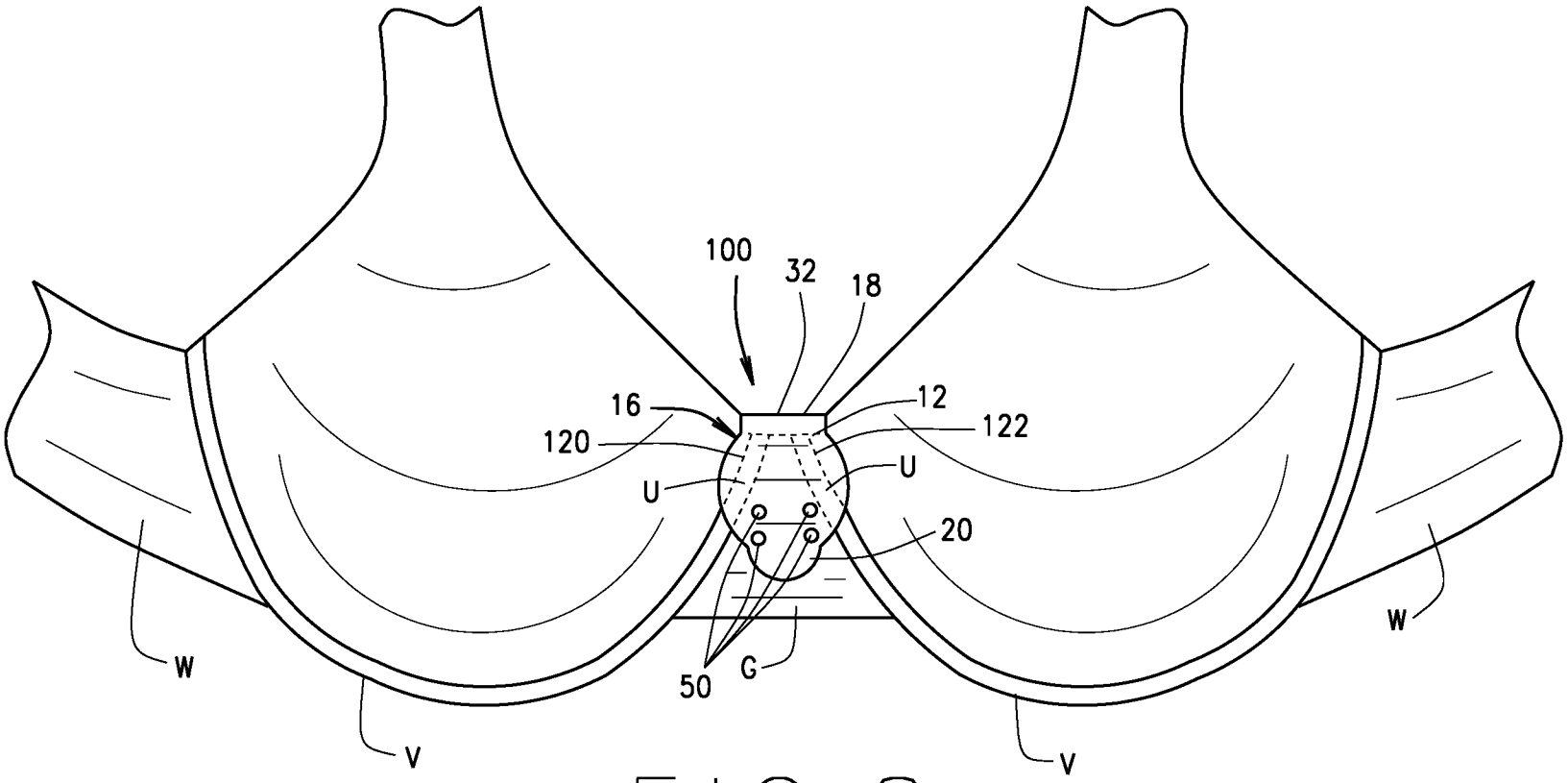
FIG. 8 is a front view of a second representative embodiment of the undergarment clip of the present disclosure attached to a representative underwire brassiere at the top edge of the center-front gore and positioned over both underwires, and having ghost lines depicting various features of the clip.

FIG. 8 depicts an alternate embodiment undergarment clip 100 of the present disclosure having a pair of tracks 120 and 122, shown as ghost images in position over respective underwires U. The undergarment clip 100 is otherwise constructed substantially the same as the undergarment clip 10. The undergarment clip 100 can be used to secure the two separate support rods in proximity to one another, such as for example a pair of underwires that meet at the center gore G of an underwire brassiere as depicted in FIG. 8 for a brassiere, such as for example the brassiere B.

While I have described in the detailed description several configurations that may be encompassed within the disclosed embodiments of this invention, numerous other alternative configurations, that would now be apparent to one of ordinary skill in the art, may be designed and constructed within the bounds of my invention as set forth in the claims. Moreover, the above-described novel undergarment clip of the present disclosure, including the undergarment clips 10 and 100, can be arranged in a number of other and related varieties of configurations without departing from or expanding beyond the scope of my invention as set forth in the claims.

For example, the track 39 for the underwire can be formed to varying depths and lengths on both the front and rear blades 12 and 22, with grooves having different depths or the same depth as depicted in FIGS. 2-7. Alternately, the track 39 can be formed entirely in either the front blade 12 or the rear blade 22.

Figure 12:
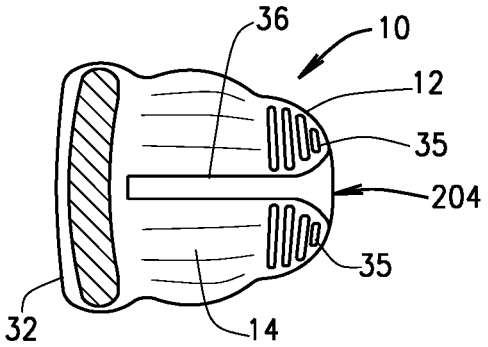
FIG. 12 is a side view of the back side of the front blade of an alternate representative embodiment of the bra clip of the present disclosure in which the central channel is fluted at one end.
Figure 13:
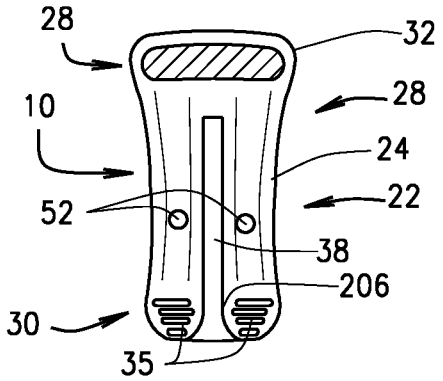
FIG. 13 is a side view of the back side of the rear blade of an alternate representative embodiment of the bra clip of the present disclosure in which the central channel is fluted at one end.
Figure 16:
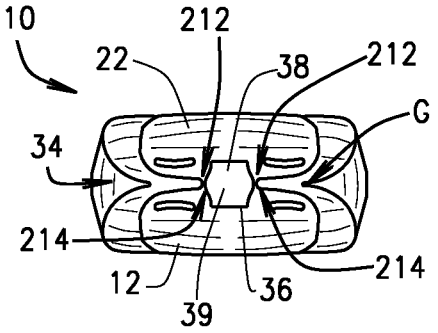
FIG. 16 is a bottom view of an alternate representative embodiment of the bra clip of the present disclosure in which the channel comprises protrusions that extend from the inner surface of the front and rear blades.

Of course, the track 39 can be of many varied shapes and sizes without departing from the novel features of the invention. That Is, the track 39 can for example have a cross-section that is alternately oval, square, rectangular or irregular-shaped, or can be thicker, thinner or of varied thickness, or may comprise one or more protrusions extending from one of the blades 12 or 22 (see, e.g., opposing protrusions 212 and 214 of FIG. 16), so long as the undergarment clip 10 or 100 can be secured to an undergarment as indicated in this disclosure and receive and hold at least one end of one or more of the undergarment support components, such as a brassiere underwire U. Further, the track 39 can include fluting or a mouth (see, e.g., fluted areas or mouths 204 and 206 of FIGS. 12 and 13) that opens wider at the outer edge of the undergarment clip 10 or 100 to allow the user to more easily position the end of the underwire U in the track 39 as the undergarment clip 10 or 100 is slipped onto the undergarment. As can be appreciated. Such fluting at the bottom end of the track 39 allows for more tolerance in the placing of the underwire U into the track 39.

By way of further example, the undergarment clip 10 can also be configured with more than one track 39, such as disclosed in undergarment clip 100 to accommodate the two underwires conversing at the center gore G, but can also be configured with multiple tracks 39 to receive a single support component or underwire at different lateral positions on the clip. This provides versatility such that a single undergarment clip can fit a variety of styles and sizes of undergarments, such as for example underwire brassieres.

Additionally, the shape and dimensions of the undergarment clip of the present disclosure, including the undergarment clips 10 and 100, including the gap G, can have a variety of shapes and sizes, so long as the undergarment clip 10 can be secured to a desired undergarment, such as for example an underwire brassiere, as indicated in this disclosure, and receive and hold the end of one or more of the undergarment support structures or rods, such as brassiere underwire. In one such embodiment, the undergarment clip 10 or 100 can be sized and shaped to fit under the fabric of an underwire brassiere at the end of the underwire, such that the clip can be a component of the underwire brassiere during production of the garment.

Figure 11:
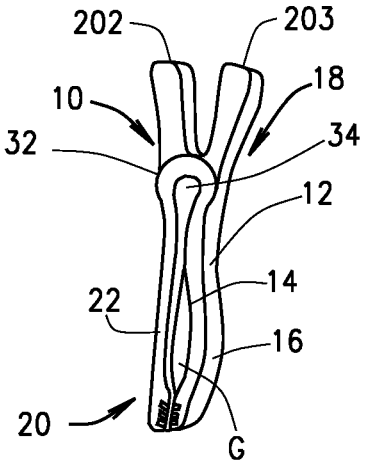
FIG. 11 is a perspective view of an alternate representative embodiment of the bra clip of the present disclosure in which each of the blades extends above the spine.
Figure 14:
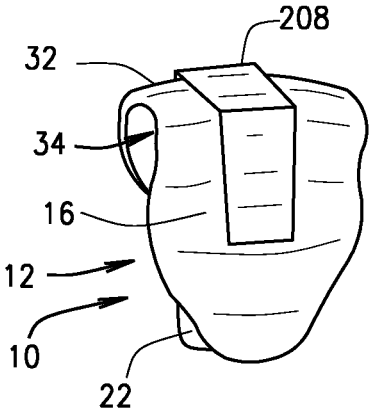
FIG. 14 is a perspective view of an alternate representative embodiment of the bra clip of the present disclosure in which the clip includes a spring clip or clasp about the front and rear blades.
Figure 15:
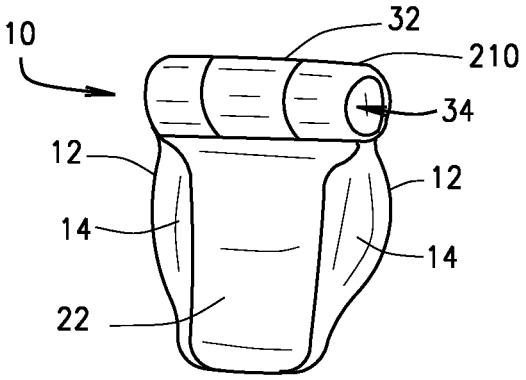
FIG. 15 is a perspective view of an alternate representative embodiment of the bra clip of the present disclosure in which the spine comprises a hinge.

The undergarment clips 10 and 100 may also be constructed such that the spine composes a pivot or hinge (see, e.g., hinge 210 of FIG. 15) that is preferably biased such that the front and rear blades rotate about the pivot or hinge to engage the end of the underwire or other such support rod or component in the undergarment. The undergarment clips 10 and 100 may also include a biasing member, such as for example a spring (see, e.g., compressive spring clip 208 of FIG. 14, said spring clip 208 being positioned over the front and rear blades 12 and 22 and urging the blades together), an elastic arm or other such device, such that the biasing member imparts the bias to urge the front and rear blades 12, 22 toward one another. By way of further example, either or both of the front and rear blades may be constructed to extend above the spine (see, e.g., extension tabs 202 and 203 of FIG. 11).

Additional variations or modifications to the configuration of the novel undergarment clip of the present disclosure, including the undergarment clips 10 and 100, may occur to those skilled in the art upon reviewing the subject matter of this invention. Such variations, if within the spirit of this disclosure, are intended to be encompassed within the scope of this invention. Therefore, the description of the embodiments as set forth herein, and as shown in the drawings, is provided for illustrative purposes only and, unless otherwise expressly set forth, is not intended to limit the scope of the claims, which set forth the metes and bounds of my invention.

What is claimed is:

1. A protective clip for an undergarment, the undergarment having a fabric sleeve surrounding at least in part a support rod, the support rod having a first end segment positioned within an end portion of the fabric sleeve, said first end segment terminating proximate an edge of the undergarment, the protective clip comprising:

a. a first blade, the first blade being generally flat and having an outer surface with an inner surface opposite the outer surface, the first blade further having an upper edge and a lower edge generally opposite the upper edge;

b. a second blade, the second blade being generally flat and having an outer surface with an inner surface opposite the outer surface, the second blade having an upper edge and a lower edge generally opposite the upper edge;

c. a spine joining the upper edge of the first blade to the upper edge of the second blade such that the inner surface of the first blade faces and is generally parallel to the inner surface of the second blade; and d. a track positioned at least in part on the inner surface of the first blade, said track extending from a position proximate the lower edge of said first blade inner surface toward said spine, said track being shaped and sized to receive at least in part the first end segment of the support rod, said track being configured so as not to penetrate the first blade outer surface;

the protective clip being sized and shaped to enable the first and second blades to mount at least in part over the edge of the undergarment proximate the first end segment of the support rod to securely attach the protective clip to the undergarment when the first end segment of the support rod is positioned in the track.

2. The protective clip of claim 1, wherein the first and second blades are separated at least in part by a gap.

3. The protective clip of claim 1, wherein the spine comprises a central axis and said spine is elastic at least in part about said axis.

4. The protective clip of claim 1, wherein the clip is constructed to impart a bias on at least one of said first blade and said second blade when the clip is positioned on the undergarment over the first end segment of the support rod, said bias urging the blades towards one another.

5. The protective clip of claim 4, wherein the spine imparts at least in part the bias.

6. The protective clip of claim 4, further comprising a spring, said spring imparting at least in part the bias.

7. The protective clip of claim 1, wherein at least one of said first and second blades is at least in part elastic or rigid.

8. The protective clip of claim 1, wherein the inner surface of said first blade comprises a fabric grip.

9. The protective clip of claim 8, wherein the fabric grip comprises a protrusion formed in and extending from said first blade inner surface.

10. The protective clip of claim 1, wherein said track comprises a receiving end opposite the spine, the receiving end being fluted.

11. The protective clip of claim 1, wherein said track comprises one or more of a channel, a groove, a slot and a protrusion.

12. The protective clip of claim 1, wherein said first blade inner surface and said second blade inner surface collectively define said track.

13. The protective clip of claim 1, wherein said track extends from a first position proximate the lower edge of said first blade to a second position proximate the upper edge of said first blade.

14. The protective clip of claim 1, wherein the spine comprises a hinge, the first and second blades being adapted to rotate about said hinge.

15. The protective clip of claim 1, wherein for a specific undergarment comprising a support rod having a first end segment with a known curvature, the track comprises a designated curvature that corresponds to said known curvature.

16. The protective clip of claim 15, wherein said first blade extends at least in part vertically above the spine.

17. The protective clip of claim 1, wherein the support rod comprises an underwire.

18. The protective clip of claim 1, further comprising an orifice in one of said first blade and said second blade, said orifice being sized and shaped to receive a sewing fiber there through.

19. A protective clip for an underwire brassiere, the brassiere having a fabric sleeve surrounding at least in part an underwire, the underwire having a first end segment positioned within an end portion of the fabric sleeve, said first end segment terminating proximate an edge of the brassiere, the protective clip comprising:

a. a first blade, the first blade being generally flat and having an outer surface with an inner surface opposite the outer surface, the first blade further having an upper edge and a lower edge generally opposite the upper edge;

b. a second blade, the second blade being generally flat and having an outer surface with an inner surface opposite the outer surface, the second blade having an upper edge and a lower edge generally opposite the upper edge;

c. a pliant spine joining the upper edge of the first blade to the upper edge of the second blade such that the inner surface of the first blade faces and is generally parallel to the inner surface of the second blade, said spine adapted to allow said first blade to rotate about the spine relative to said second blade; and d. a narrow and elongate track positioned at least in part on the inner surface of the first blade, said track extending from the lower edge of said first blade toward the spine and being oriented generally perpendicular to said lower edge of said first blade, said track being shaped and sized to receive at least in part the first end segment of the underwire without penetrating the outer surface of the first blade;

the protective clip being sized and shaped to enable the first and second blades to mount at least in part over the edge of the brassiere proximate the first end segment of the underwire to securely attach the protective clip to the brassiere when the first end segment of the underwire is positioned in the track.

20. The protective clip of claim 19, wherein said track comprises a receiving end opposite the spine, the receiving end being fluted.

21. The protective clip of claim 19, wherein the inner surface of said first blade comprises a fabric grip.

22. The protective clip of claim 21, wherein the fabric grip comprises a protrusion formed in and extending from said first blade inner surface.

23. The protective clip of claim 19, wherein the first and second blades are separated at least in part by a gap.

24. The protective clip of claim 19, wherein the clip is constructed to impart a bias on one or more of said first blade and said second blade, said bias urging the first and second blades towards one another.

25. The protective clip of claim 24, wherein the spine imparts at least in part said bias.

26. The protective clip of claim 24, further comprising a biasing member, said biasing member imparting said bias urging the first and second blades towards one another.

27. The protective clip of claim 19, wherein at least one of said first and second blades is at least in part elastic or rigid.

28. The protective clip of claim 19, wherein said track comprises one or more of a channel, a groove, a slot and a protrusion.

29. The protective clip of claim 19, wherein said first blade inner surface and said second blade inner surface collectively define said track.

30. The protective clip of claim 19, wherein said track extends from a first position proximate the lower edge of said first blade to a second position proximate the upper edge of said first blade.

31. The protective clip of claim 19, wherein said track comprises a horizontal hinge, the first and second blades being adapted to rotate about said hinge.

32. The protective clip of claim 19, wherein for a specific undergarment comprising a support rod having a first end segment with a known curvature, the track comprises a designated curvature that corresponds to said known curvature.

33. The protective clip of claim 19, wherein one of said first blade and said second blade extends at least in part vertically above the spine.

34. The protective clip of claim 19, further comprising an orifice in one of said first and second blades, said orifice being sized and shaped to receive a sewing fiber there through.

* * * * *